US012534918B2

(12) United States Patent
Demuth, II et al.

(10) Patent No.: US 12,534,918 B2
(45) Date of Patent: Jan. 27, 2026

(54) SPLASH BLOCK

(71) Applicant: Avon Plastics, Inc., Paynesville, MN (US)

(72) Inventors: Nicholas Demuth, II, St. Cloud, MN (US); Nicholas J. Demuth, Cold Spring, MN (US); Mark T. Reum, Avon, MN (US); Brian M. Kimble, Zionsville, IN (US)

(73) Assignee: Avon Plastics, Inc., Paynesville, MN (US)

( * ) Notice: Subject to any disclaimer, the term of this patent is extended or adjusted under 35 U.S.C. 154(b) by 328 days.

(21) Appl. No.: 17/991,830

(22) Filed: Nov. 21, 2022

(65) Prior Publication Data

US 2024/0167283 A1 May 23, 2024

(51) Int. Cl.
*E04D 13/08* (2006.01)

(52) U.S. Cl.
CPC ..... *E04D 13/08* (2013.01); *E04D 2013/0813* (2013.01)

(58) Field of Classification Search
CPC .... E02B 9/04; E04D 2013/0813; E04D 13/08
USPC ..... 405/119
See application file for complete search history.

(56) References Cited

U.S. PATENT DOCUMENTS

| | | | | |
|---|---|---|---|---|
| 2,571,417 | A * | 10/1951 | Buchanan | B28B 7/0029 249/13 |
| 3,048,983 | A * | 8/1962 | Crummel | E04D 13/08 404/2 |
| 3,636,830 | A * | 1/1972 | Watts | E04D 13/08 404/2 |
| 7,954,289 | B2 * | 6/2011 | Evans | E01F 9/685 403/374.1 |
| 9,309,995 | B2 * | 4/2016 | Bell | E04D 13/08 |
| D833,036 | S * | 11/2018 | Elliott | D25/112 |
| 2012/0011802 | A1 * | 1/2012 | Bertucci | E04D 13/08 405/119 |

FOREIGN PATENT DOCUMENTS

DE 19952823 * 5/2001

* cited by examiner

*Primary Examiner* — Sean D Andrish
(74) *Attorney, Agent, or Firm* — Skaar Ulbrich Macari, P.A.

(57) ABSTRACT

A splash block can include a base surface and a raised sidewall surrounding the base surface except for an outlet side of the base surface. The raised sidewall defines an inlet sidewall located opposite the outlet side of the base and a pair of longitudinal sidewalls spanning from the inlet sidewall towards the outlet side of the base. A tab is provided to the inlet sidewall. The tab is attached to the inlet sidewall such that the tab can pivot between a first position extending horizontally outwardly away from the base surface and a second position folded under the splash block such that the tab does not protrude outwardly from the raised sidewall. A first aperture can be defined in the tab to receive an anchor spike. A second aperture can be defined in the base surface adjacent to the outlet side in order to receive an anchor spike.

18 Claims, 10 Drawing Sheets

SPLASH BLOCK

FIELD

The present invention generally relates to lawn and garden items, and more particularly to splash blocks that can be used to prevent erosion under and near gutter downspouts.

BACKGROUND

Water from rainfall landing on rooftops is often directed through gutters or other collection means and directed to the ground. Downspouts and other means that concentrate the water as it reaches the ground can cause soil erosion. Therefore, there is a need for devices and methods to reduce soil erosion due to water being directed towards the ground via gutter downspouts and the like.

SUMMARY

A splash block can include a base surface and a raised sidewall surrounding the base surface except for an outlet side of the base surface. The raised sidewall defines an inlet sidewall located opposite the outlet side of the base and a pair of longitudinal sidewalls spanning from the inlet sidewall towards the outlet side of the base. A tab is provided to the inlet sidewall. The tab is attached to the inlet sidewall such that the tab can pivot between a first position extending horizontally outwardly away from the base surface and a second position folded under the splash block such that the tab does not protrude outwardly from the raised sidewall. A first aperture can be defined in the tab to receive an anchor spike. A second aperture can be defined in the base surface adjacent to the outlet side in order to receive an anchor spike.

The base surface can slope downward from the inlet sidewall towards the outlet side of the base surface. The base surface can slope inward from each of the pair of longitudinal sidewalls such that a trough is defined along a longitudinal midline of the base surface. The base surface at the outlet side can be wider than a width of the base surface at the inlet sidewall. The pair of longitudinal sidewalls can diverge from one another from the inlet sidewall extends towards the outlet side of the base surface.

The base surface can include a plurality of raised ribs. The raised ribs can be angled towards the inlet end as the ribs extend from a respective one of the pair of longitudinal sidewalls towards a longitudinal midline of the base surface such that an obtuse angle is defined at a midpoint of each raised rib.

The tab is attached to the inlet sidewall via a first film hinge. The tab can also include a second film hinge that is oriented parallel to the first film hinge.

The tab can include or more apertures defined through the tab. An aperture can be defined through the base surface at a location adjacent to the outlet side thereof. The aperture adjacent to the outlet side can be covered with a frangible film membrane. The aperture(s) in the tab also can be covered with a frangible film membrane.

A splash block system can include one or more anchor spikes and a splash block. The apertures or holes in the tab and/or base surface are sized and shaped to receive the anchor spike. The anchor spike can be a nail.

The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
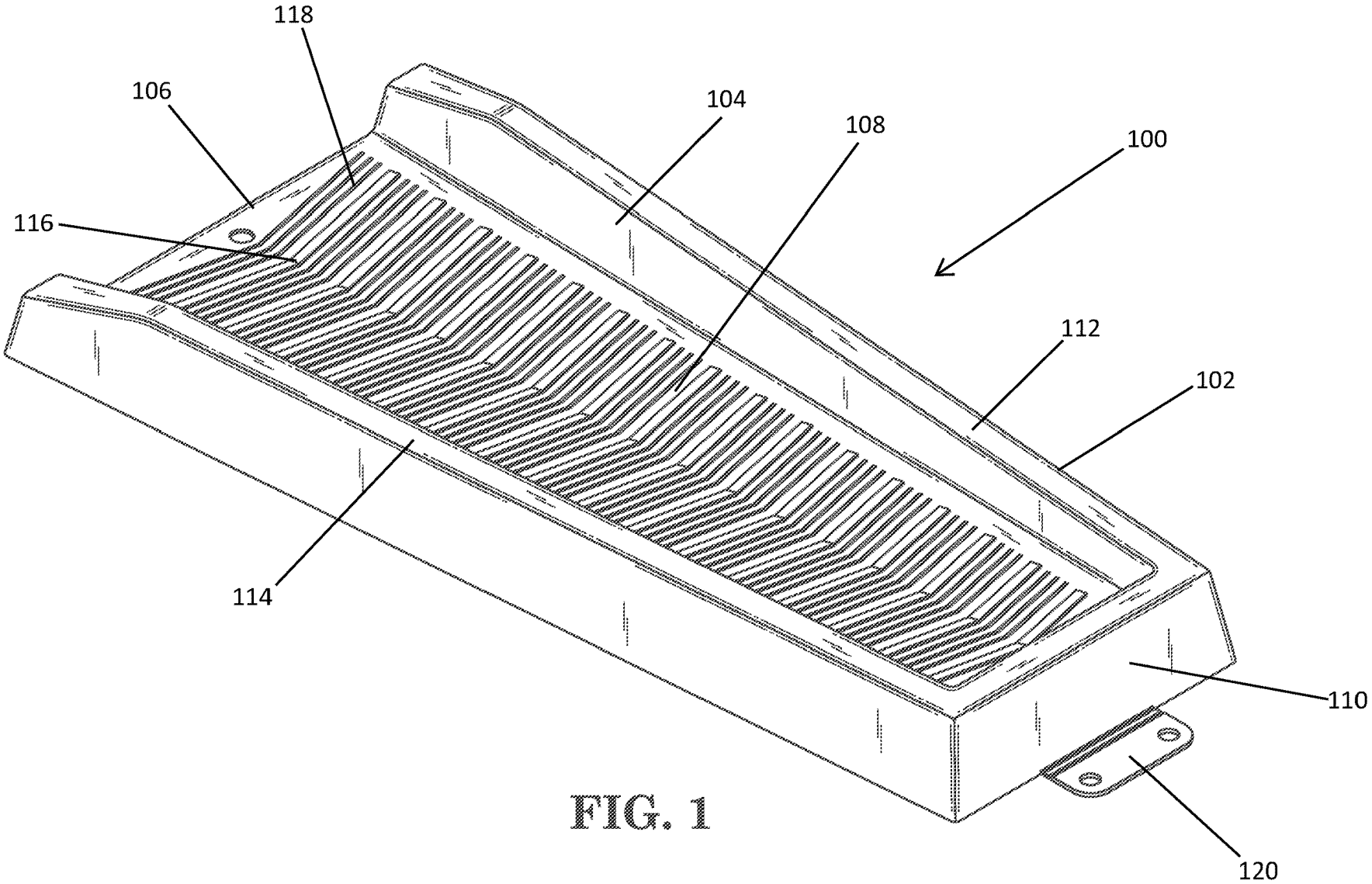
FIG. 1 is a perspective view of a splash block in accordance with embodiments of the present invention.

While the invention is amenable to various modifications and alternative forms, specifics thereof have been shown by way of example in the drawings and will be described in detail. It should be understood, however, that the intention is not to limit the invention to the particular exemplary embodiments described. On the contrary, the invention is to cover all modifications, equivalents, and alternatives falling within the spirit and scope of the invention as defined by the appended claims.

DETAILED DESCRIPTION

In the following descriptions, the present invention will be explained with reference to exemplary embodiments thereof. However, these embodiments are not intended to limit the present invention to any specific example, embodiment, environment, applications, or particular implementations described in these embodiments. Therefore, description of these embodiments is only for purpose of illustration rather than to limit the present invention.

Dimensions and relative proportions of components are merely example embodiments and can be varied unless specifically limited in a given claim. Thus, the dimensions can be varied without departing from the scope of the invention.

Referring generally to FIGS. 1-6, the splash block 100 comprises a molded plastic (or similar material) body 102 that includes a raised sidewall 104 that forms a perimeter on three sides of the splash block. The fourth side is open to define an outlet 106. A base surface 108 spans between the sidewalls and the outlet 106. The base surface 108 slopes downward from the inlet end 110 towards the outlet end 106. In addition, the base surface 108 slopes inward from each of the longitudinal (long) sidewall portions 112, 114 such that a low point or trough 116 is defined along a longitudinal midline of the body 102.

Figure 2:
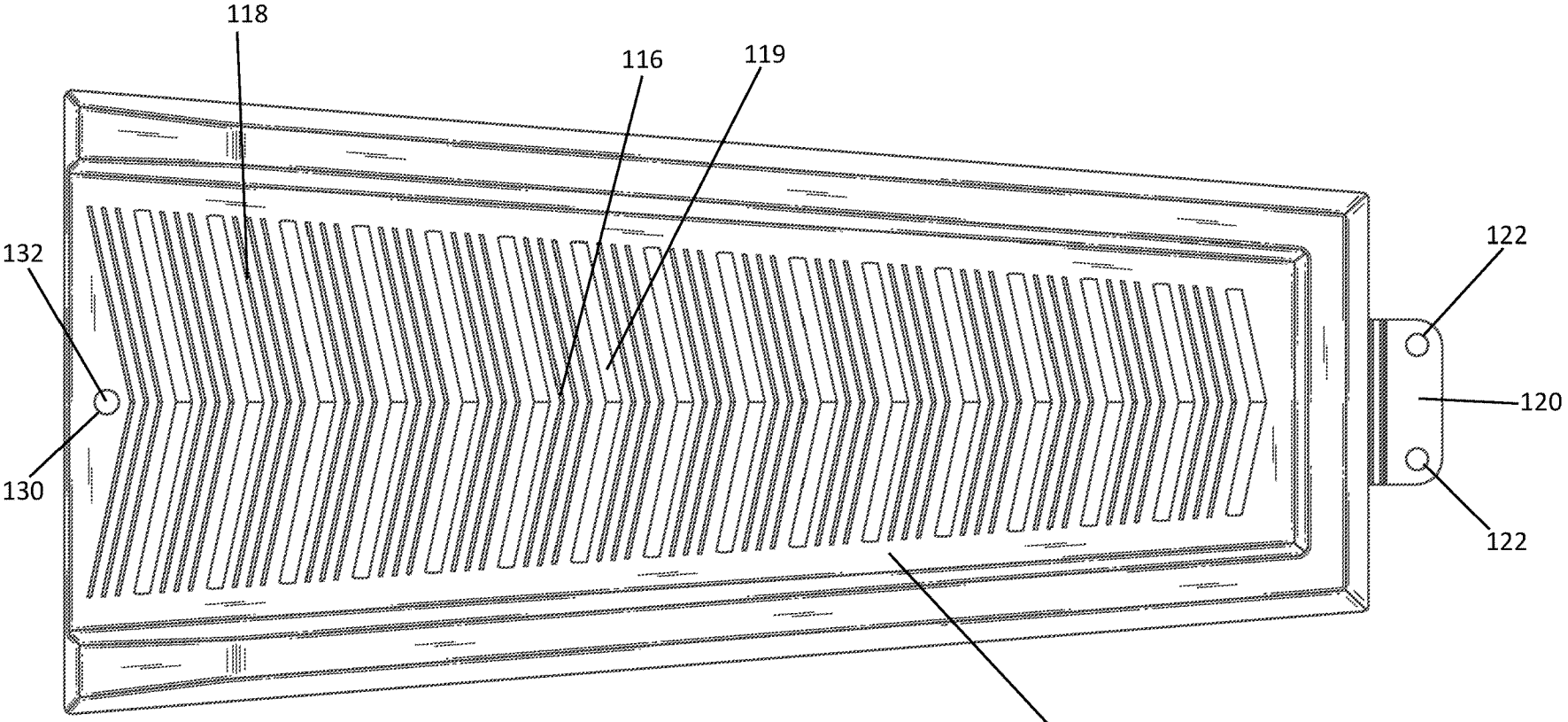
FIG. 2 is a top view of the splash block of FIG. 1.
Figure 3:
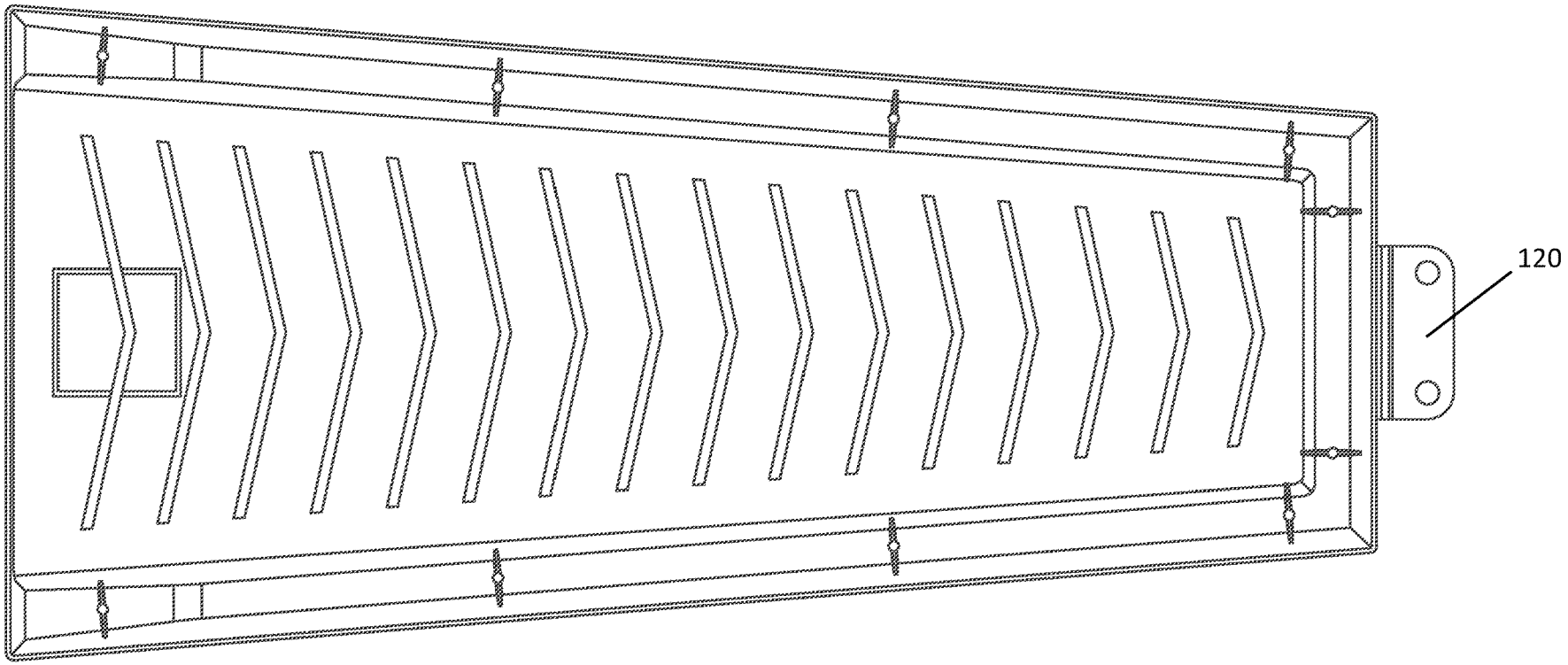
FIG. 3 is a bottom view of the splash block of FIG. 1.
Figure 4:
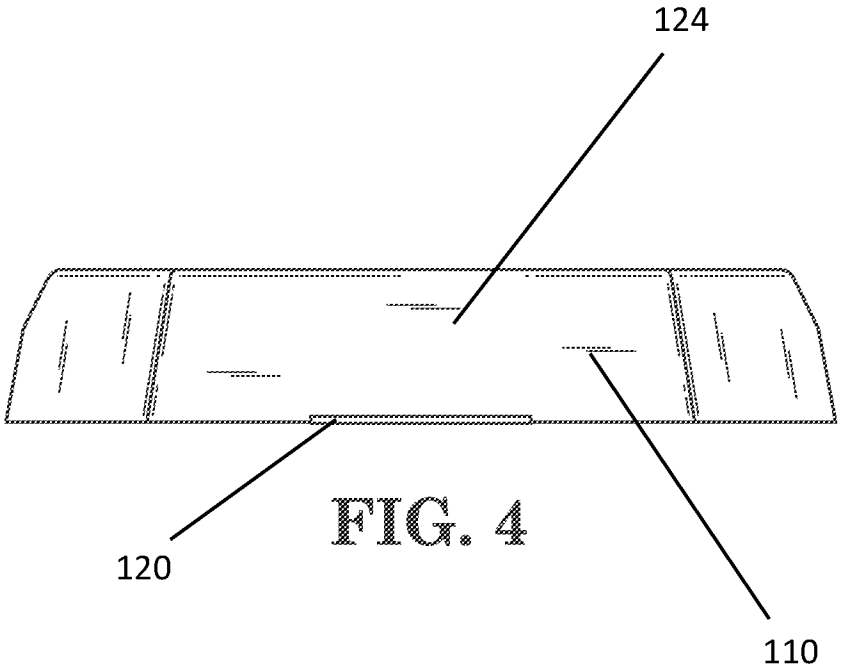
FIG. 4 is a first longitudinal end view of the splash block of FIG. 1.
Figure 5:
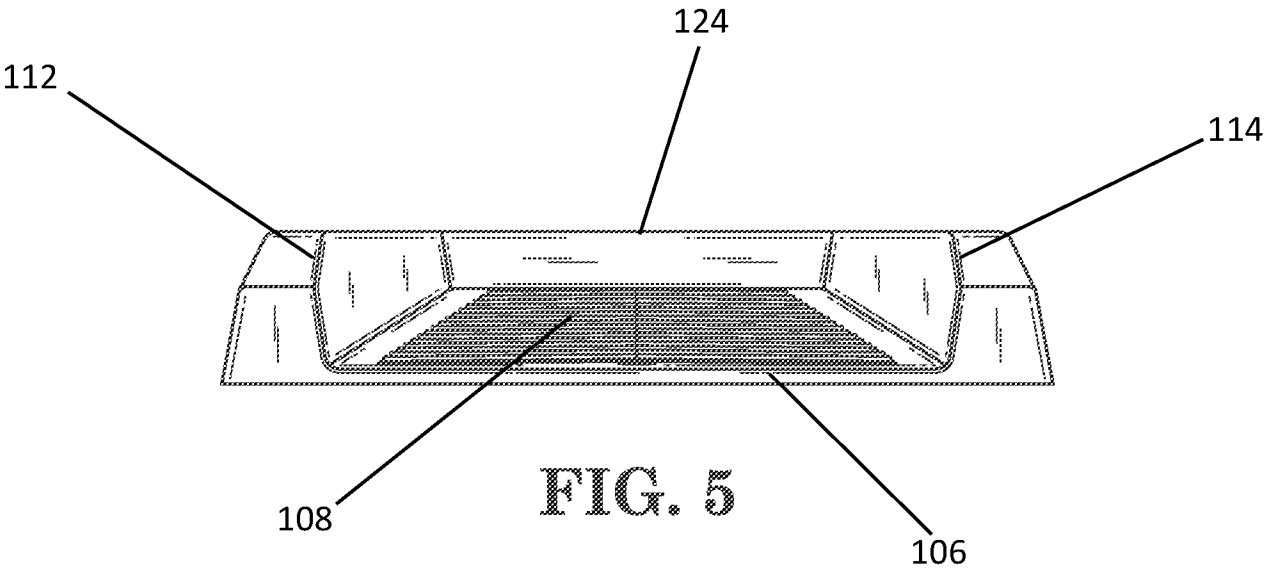
FIG. 5 is a second longitudinal end view of the splash block of FIG. 1 from the end opposite that of FIG. 4.
Figure 6:
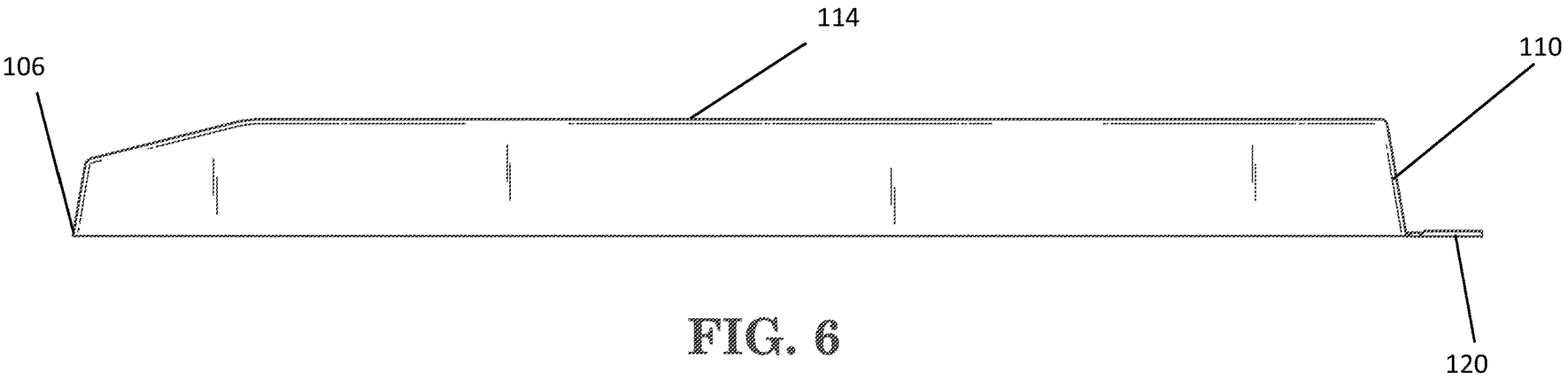
FIG. 6 is a side view of the splash block of FIG. 1.

In plan view, such as FIG. 2, it can be seen that the inlet end 110 is narrower than the outlet end 106. The longitudinal sidewall portions 112, 114 diverge from the inlet end 110 towards the outlet 106.

A plurality of ribs 118 are provided atop the base surface 108. The ribs 118 are slanted or angled towards the inlet end 110 as the ribs 118 extend from the respective longitudinal sidewall portions 112, 114 towards the trough 116. Thus, an obtuse angle is defined at the midpoint of each rib 118. Between ribs there can also be defined recesses 119 in the base surface 108 that have the same orientations as the ribs 118.

The ribs 118 and their angling serve to slow down the speed of the water flowing longitudinally across the base surface 108. The increasing width of the base surface 108 as the water flows towards the outlet 106 enhance the flow slowing effect. The ribs 118, their angling, and the increasing width features also serve to spread out the water volume so that the water being discharged from the outlet 106 has reduced force that will minimize erosion.

An anchoring tab 120 extends outward from the inlet end 110. The tab 120 includes a pair of holes 122 or apertures vertically therethrough. The holes 122 allow a user to place an anchor spike or nail to anchor the splash block 100 to the ground. The holes 122 also allow the splash block to hang from post in a merchandising display in a retail store. In alternative embodiments, the holes 122 can be shaped as slots or other shapes, and there can be only one hole/slot or more than two holes/slots.

Figure 10:
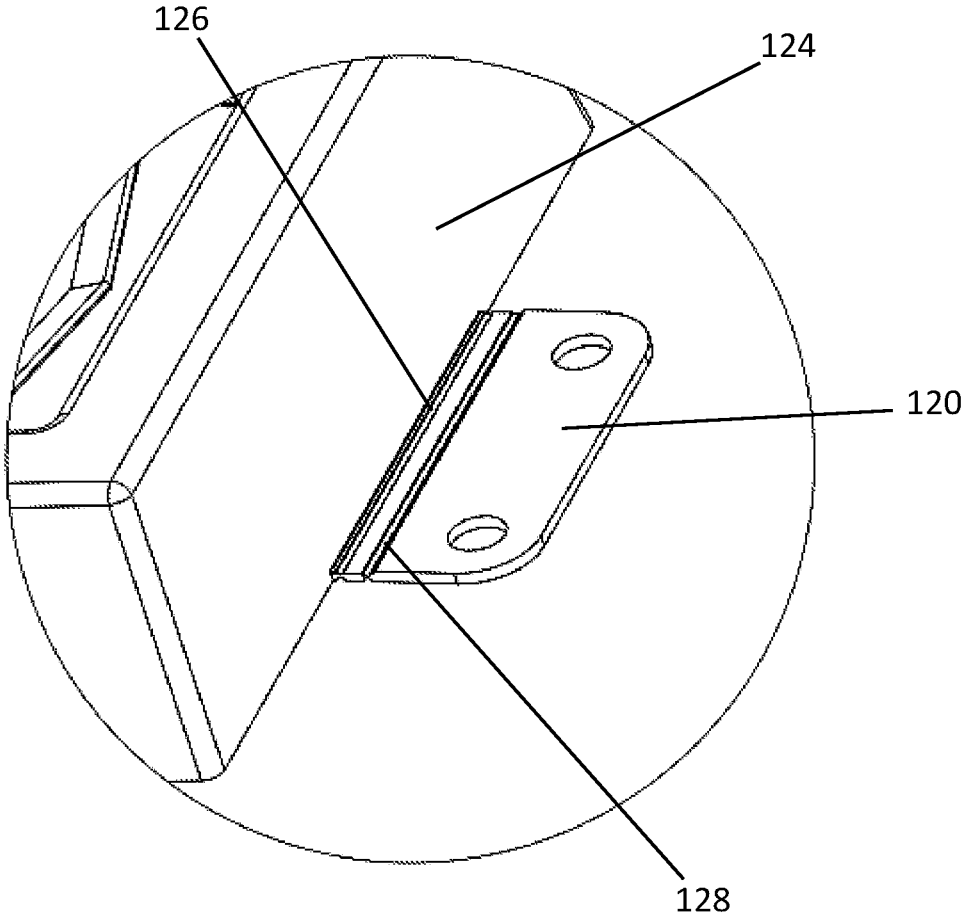
FIG. 10 is a perspective close-up view of the tab of the splash block of FIG. 1 in accordance with embodiments of the present invention.

Referring additionally to FIG. 10, the tab 120 is pivotally secured to the outer surface of the inlet wall portion 124 along an edge of the tab. The pivoting can be provided via a film hinge 126. A second notch or score line that defines a second film hinge 128 is disposed adjacent to the first film hinge 126. Both film hinges 126, 128 extend parallel to one another.

Figure 8:
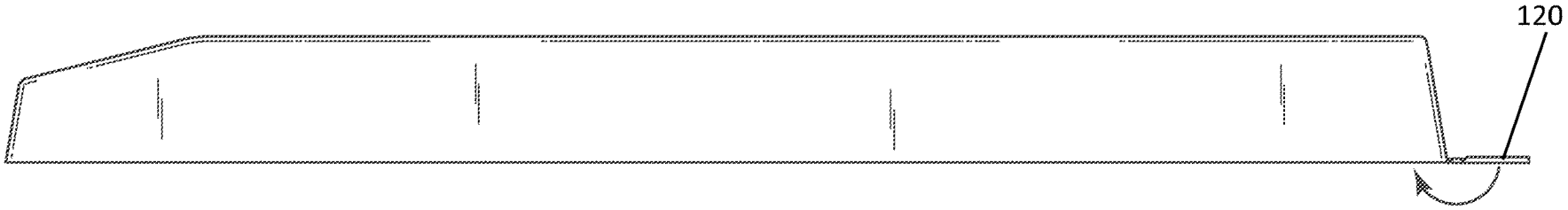
FIG. 8 is a side view of the splash block of FIG. 1 showing the tab in an extended position) in accordance with embodiments of the present invention.
Figure 9:
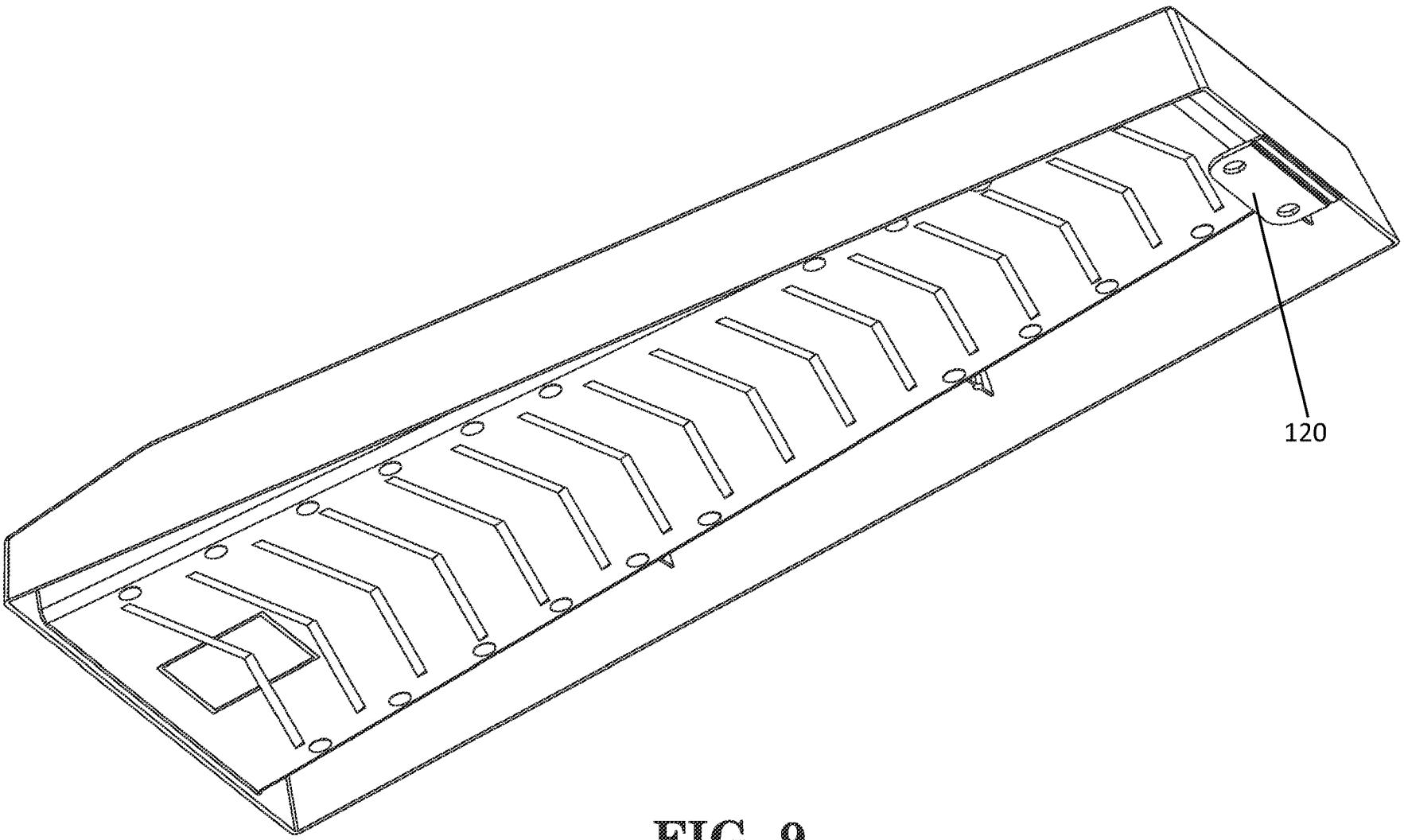
FIG. 9 is a perspective view of the splash block of FIG. 1 showing the tab in a folded position in accordance with embodiments of the present invention.

Referring additionally to FIGS. 8-9, the hinged tab configuration allows the outwardly-extending tab 120, shown in FIG. 8, to be folded underneath the base surface 108, as shown in FIG. 9, so that the tab 120 is hidden and does not extend outwardly. This allows a user to place the splash block 100 such that the inlet wall portion 124 abuts up against an object, such as a wall, without the need to remove the tab 120. Thus, the tab 120 is still present in case the splash block is later desired to be anchored with a nail or spike through the hole 122 in the tab 120.

Referring to FIG. 2, it can be seen that a secondary aperture or anchor hole 130 is defined adjacent to the outlet 106 end. Again this secondary anchor hole 130 could be shaped as a slot or other shape, and more than one hole can be provided. The secondary anchor hole 130 provides for placement of an anchor spike or nail adjacent to the outlet 106. Thus, the user can anchor the splash block 100 on one or both of the inlet and outlet ends.

The secondary anchor hole 130 can be formed with a film membrane 132 covering the hole 130 such that water can flow across the hole 130 and not into it. That is why in FIG. 3 that the secondary anchor hole 130 is not visible. The user punctures the membrane 132 with the nail or spike when inserting the spike through the hole 130.

Figure 7:
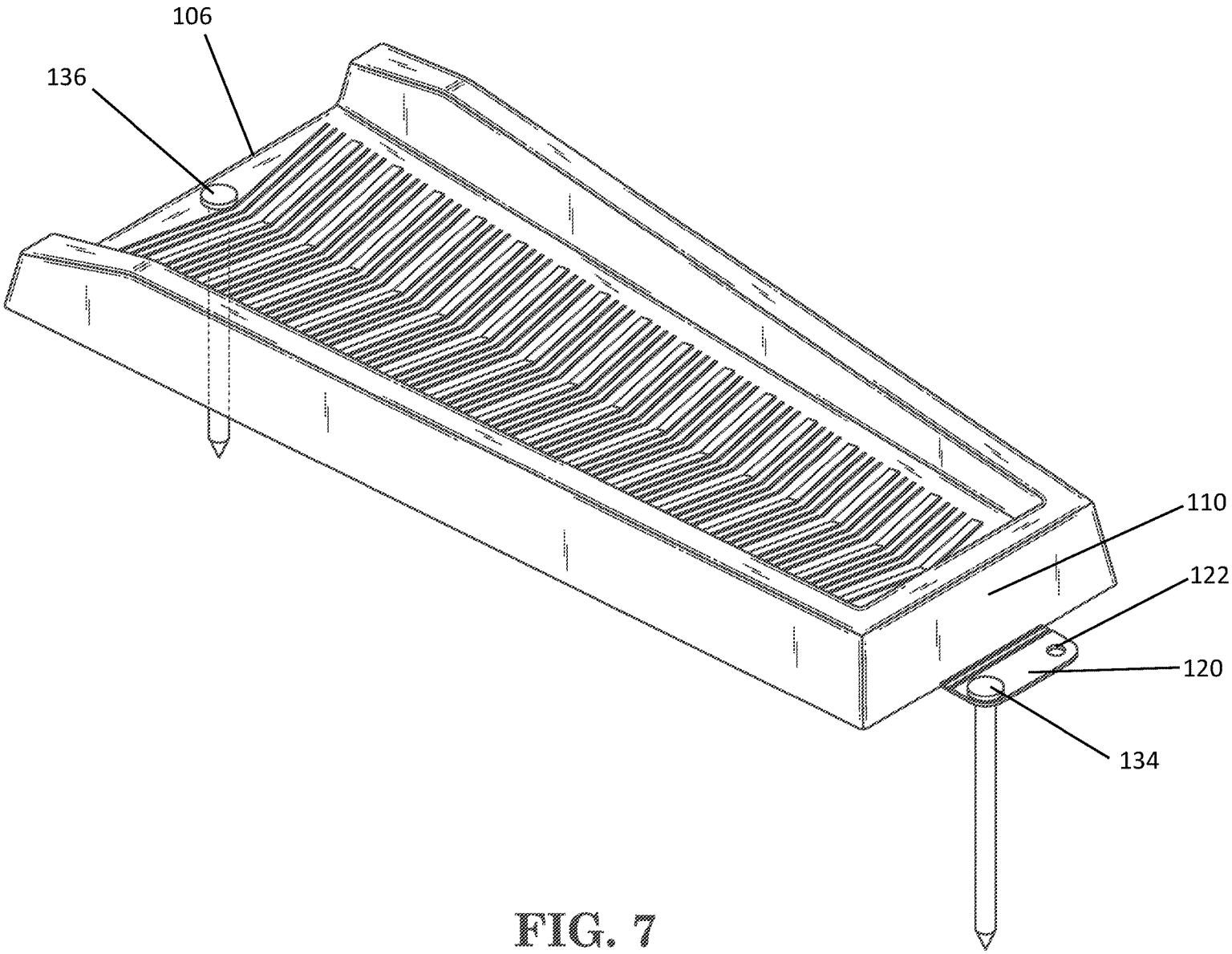
FIG. 7 is a perspective view of the splash block of FIG. 1 with anchor spikes or nails disposed in the splash block in accordance with embodiments of the present invention.

Referring to FIG. 7, the splash block is shown with a first anchor spike 134 inserted through a hole 122 in the tab 120. A second anchor spike 136 is inserted through the secondary anchor hole 130. The spikes 134, 136 would penetrate into the earth when the splash block is set upon the ground and the spikes are inserted. Depending on the user's preferences, and the particular location, it may not be necessary to use the anchor spikes, or only one of the spikes may be used (either through the tab 120 or through the secondary anchor hole 130).

In an alternative, the first anchor spike 134 can be inserted through the hole 122 in the tab 120 in the opposite direction while the body 102 extends vertically or somewhat vertically with respect to the ground. This allows the spike 134 to be inserted into the ground and then the splash block can be folded down on top of the tab, such as shown in FIG. 9, but with the spike 134 anchored into the ground. Thus, the spike 134 through the tab 120 can be hidden from view and the inlet end 110 can directly abut an object or surface while still being anchored.

In use, the user decides whether the tab 120 should extend outwards or be folded underneath the body 102. Then the user sets the splash block 100 upon the ground in a location where the water falling on the splash block 100 will contact the base surface 108 adjacent to an inlet end 110 thereof. The splash block 100 is oriented so that the outlet 106 is downstream of the inlet end 110. One or more anchor spikes 134, 136 can be used to anchor the splash block 100 so that it does not move across the ground due to the force exerted by the water contacting the base surface 108. These spikes can be inserted through a hole in the tab 120 and/or the secondary anchor hole 130.

The splash block 100 can be formed of a rigid plastic, or other suitable materials, including metal and concrete. The spikes 134, 136 can be a rigid material such as plastic, fiberglass or metal.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. A splash block, comprising:

a base surface;

a raised sidewall surrounding the base surface except for an outlet side of the base surface, the raised sidewall defining an inlet sidewall located opposite the outlet side of the base surface and a pair of longitudinal sidewalls spanning from the inlet sidewall towards the outlet side of the base surface; and a tab provided to the inlet sidewall, the tab attached to the inlet sidewall via a first film hinge such that the tab can pivot between a first position extending horizontally outwardly away from the base surface and a second position folded under the splash block such that the tab does not protrude outwardly from the raised sidewall.

2. The splash block of claim 1, wherein the base surface slopes downward from the inlet sidewall towards the outlet side of the base surface.

3. The splash block of claim 2, wherein the base surface slopes inward from each of the pair of longitudinal sidewalls such that a trough is defined along a longitudinal midline of the base surface.

4. The splash block of claim 3, wherein the base surface at the outlet side is wider than a width of the base surface at the inlet sidewall.

5. The splash block of claim 3, wherein the pair of longitudinal sidewalls diverge from one another as the pair of longitudinal sidewalls extend in a direction towards the outlet side of the base surface.

6. The splash block of claim 2, wherein the base surface includes a plurality of raised ribs.

7. The splash block of claim 6, wherein the raised ribs are angled towards the inlet end as the ribs extend from a respective one of the pair of longitudinal sidewalls towards a longitudinal midline of the base surface such that an obtuse angle is defined at a midpoint of each raised rib.

8. The splash block of claim 1, wherein the base surface slopes inward from each of the pair of longitudinal sidewalls such that a trough is defined along a longitudinal midline of the base surface.

9. The splash block of claim 1, wherein the base surface at the outlet side is wider than a width of the base surface at the inlet sidewall.

10. The splash block of claim 1, wherein the pair of longitudinal sidewalls diverge from one another as the pair of longitudinal sidewalls extend in a direction towards the outlet side of the base surface.

11. The splash block of claim 1, wherein the base surface includes a plurality of raised ribs.

12. The splash block of claim 11, wherein the raised ribs are angled towards the inlet end as the ribs extend from a respective one of the pair of longitudinal sidewalls towards a longitudinal midline of the base surface such that an obtuse angle is defined at a midpoint of each raised rib.

13. The splash block of claim 1, wherein the tab includes a second film hinge that is oriented parallel to the first film hinge.

14. The splash block of claim 1, wherein the tab includes an aperture defined through the tab.

15. The splash block of claim 1, wherein an aperture is defined through the base surface at a location adjacent to the outlet side thereof.

16. The splash block of claim 15, wherein the aperture is covered with a frangible film membrane.

17. A splash block system, comprising:

an anchor spike; and a splash block body, comprising:

a base surface;

a raised sidewall surrounding the base surface except for an outlet side of the base surface, the raised sidewall defining an inlet sidewall located opposite the outlet side of the base surface and a pair of longitudinal sidewalls spanning from the inlet sidewall towards the outlet side of the base surface; and a tab provided to the inlet sidewall, the tab attached to the inlet sidewall via a dual hinge joint such that the tab can pivot between a first position extending outwardly away from the base surface and a second position folded under the splash block such that the tab does not protrude outwardly from the raised sidewall, wherein the tab includes at least one aperture defined therethrough, and wherein the at least one aperture is sized and shaped to receive the anchor spike therein.

18. The splash block system of claim 17, wherein a secondary aperture is defined through the base surface at a location adjacent to the outlet side thereof, the secondary aperture sized and shaped to receive the anchor spike.

* * * * *